US011655640B2

(12) United States Patent
Abadia Perez et al.

(10) Patent No.: US 11,655,640 B2
(45) Date of Patent: May 23, 2023

(54) SELF-CLIMBING DEVICE FOR VERTICAL AND QUASI-VERTICAL CONCRETE SURFACES AND OPERATING METHOD

(71) Applicant: HWS CONCRETE TOWERS, S.L., San Sebastian (ES)

(72) Inventors: Mariano Abadia Perez, San Sebastian (ES); Jesus Montaner Fraguet, San Sebastian (ES); José Manuel Sorazu Echave, San Sebastian (ES); Iban Diaz Ochandiano, San Sebastian (ES); Borja Aguilo Portulas, San Sebastian (ES)

(73) Assignee: HWS CONCRETE TOWERS S.L., Guipuzcoa (ES)

( * ) Notice: Subject to any disclaimer, the term of this patent is extended or adjusted under 35 U.S.C. 154(b) by 570 days.

(21) Appl. No.: 16/623,674

(22) PCT Filed: Jun. 27, 2018

(86) PCT No.: PCT/ES2018/070462

§ 371 (c)(1),
(2) Date: Dec. 17, 2019

(87) PCT Pub. No.: WO2019/002654

PCT Pub. Date: Jan. 3, 2019

(65) Prior Publication Data

US 2020/0190832 A1 Jun. 18, 2020

(30) Foreign Application Priority Data

Jun. 30, 2017 (ES) ..... P201730876

(51) Int. Cl.
*E04G 3/28* (2006.01)
*E04G 11/28* (2006.01)

(52) U.S. Cl.
CPC ..... *E04G 3/28* (2013.01); *E04G 11/28* (2013.01); *E04G 2003/286* (2013.01)

(58) Field of Classification Search
CPC ..... E04G 21/3247; E04G 2003/283; E04G 3/243; E04G 17/002; E04G 11/20; E04G 2001/242; E04G 3/28
See application file for complete search history.

(56) References Cited

U.S. PATENT DOCUMENTS 561,223 A * 6/1896 Hamilton ..... B66B 9/003 104/127
3,207,263 A * 9/1965 Cull ..... B66B 9/187 187/241

(Continued)

FOREIGN PATENT DOCUMENTS

EP 1899549 A1 3/2008
EP 2365159 A1 9/2011

(Continued)

OTHER PUBLICATIONS

International Search Report for corresponding PCT application No. PCT/ES2018/070462, dated Dec. 12, 2018.

*Primary Examiner* — Brian D Mattei
*Assistant Examiner* — Kathleen M. McFarland
(74) *Attorney, Agent, or Firm* — Notaro, Michalos & Zaccaria P.C.

(57) ABSTRACT

Self-climbing device for vertical and quasi-vertical concrete surfaces with main body equipped with a main beam by way of displacement rail, and several self-motorized frames, independent of each other and separately controllable, displaceable along the main beam of the main body, all with a characteristic operating method. The present invention provides the main advantage of allowing going up or climbing any structure, device or machine, such as a crane or a working platform, being applicable and usable on both (Continued)

vertical and quasi-vertical surfaces, flat or curved, free geometry and with variable slope, and with advances or displacements unit of variable length, adapted to the structure or area to climb.

13 Claims, 5 Drawing Sheets

(56) References Cited

U.S. PATENT DOCUMENTS 3,628,223 A * 12/1971 Babee ..... E04G 11/28 249/20
3,831,711 A * 8/1974 Smith ..... A62B 1/00 182/40
4,004,654 A * 1/1977 Hamy ..... B66B 9/003 187/250
4,540,150 A * 9/1985 Tzincoca ..... E04G 11/28 249/20
4,562,989 A * 1/1986 Scheller ..... E04G 11/28 249/19
4,865,155 A * 9/1989 Montaigne ..... B66B 9/022 182/36
5,197,570 A * 3/1993 Matsui ..... B66B 9/003 187/249
6,557,817 B2 * 5/2003 Waldschmitt ..... E04G 11/28 249/19
7,191,873 B2 * 3/2007 Korchagin ..... E04G 3/28 182/147
7,281,607 B1 * 10/2007 Kiraly ..... E06C 7/12 182/102
7,413,057 B2 * 8/2008 Ellison, Jr. ..... B66B 9/022 187/245
7,513,480 B2 * 4/2009 Bergaretxe ..... E04G 11/28 249/20
7,896,133 B2 * 3/2011 Vance ..... E04G 1/20 182/141
8,602,168 B2 * 12/2013 Tschuppert ..... B66B 9/00 187/249
8,673,189 B2 * 3/2014 Schwoerer ..... E04G 11/28 249/20
8,708,100 B2 * 4/2014 Schwoerer ..... E04G 11/28 182/20
9,476,210 B2 * 10/2016 Urzelai Ezkibel ..... E04G 3/28
10,287,794 B2 * 5/2019 Neighbours ..... E04H 12/342
10,465,398 B2 * 11/2019 Herzog ..... E04G 3/28
10,486,941 B2 * 11/2019 Finschi ..... B66B 9/10
10,590,664 B2 * 3/2020 Aranburu Etxezarreta ..... E04G 3/28
10,711,470 B2 * 7/2020 Vogl ..... E04G 11/32
10,738,499 B2 * 8/2020 Carrillo Alonso .... B66C 23/207
11,248,382 B1 * 2/2022 Magnusen ..... E04G 11/28
2003/0052249 A1 * 3/2003 Waldschmitt ..... E04G 11/28 249/20
2004/0262086 A1 * 12/2004 Korchagin ..... B66B 9/187 187/239
2009/0173574 A1 * 7/2009 Hobmeier ..... E04G 11/28 182/82
2013/0020732 A1 * 1/2013 Jentsch ..... E04G 21/02 249/20
2013/0318888 A1 12/2013 Schwoerer
2013/0341122 A1 * 12/2013 Maurer ..... E04G 3/28 187/239
2013/0341813 A1 * 12/2013 Baum ..... E04G 11/28 264/33
2015/0129359 A1 * 5/2015 Urzelai Ezkibel ..... E04G 5/04 182/82
2016/0040441 A1 * 2/2016 Dingler ..... E04G 21/3223 248/241
2017/0247901 A1 * 8/2017 Carrillo Alonso ..... E04H 12/12
2018/0023308 A1 * 1/2018 Aranburu Etxezarreta ..... E04G 21/3247 52/126.1
2018/0154954 A1 * 6/2018 Bagheri ..... B62D 55/14
2018/0179770 A1 * 6/2018 Herzog ..... E04G 5/04
2018/0245357 A1 * 8/2018 Gruebler ..... E04G 11/28
2019/0071884 A1 * 3/2019 Aranburu Etxezarreta ..... E04G 3/28
2019/0145111 A1 * 5/2019 Vogl ..... E04G 11/32 249/20
2020/0332539 A1 * 10/2020 Deifel ..... E04G 11/28
2021/0002909 A1 * 1/2021 Kolb ..... E04G 21/3261
2021/0032886 A1 * 2/2021 Schmid ..... E04G 3/28
2021/0155460 A1 * 5/2021 Gomez Mora ..... B66C 23/207
2021/0156156 A1 * 5/2021 Mork ..... E04G 17/002
2021/0198908 A1 * 7/2021 Liu ..... E04G 3/28
2021/0270242 A1 * 9/2021 Garcia De La Pena Razquin ..... B66C 23/207
2021/0293037 A1 * 9/2021 Schmid ..... E04G 11/24
2021/0362980 A1 * 11/2021 Barker ..... B66B 9/187
2022/0251858 A1 * 8/2022 Montaner Fraguet .. E04G 5/046

FOREIGN PATENT DOCUMENTS

EP 2518239 A1 10/2012
EP 2725166 A1 4/2014
ES 2085196 A2 5/1996
ES 2435211 A1 12/2013
JP 2003147956 A 5/2003
WO 2008061922 A1 5/2008
WO 2009117986 A1 10/2009
WO 2013171359 A1 11/2013

* cited by examiner

SELF-CLIMBING DEVICE FOR VERTICAL AND QUASI-VERTICAL CONCRETE SURFACES AND OPERATING METHOD

The present specification relates, as its title indicates, to a self-climbing device for vertical and quasi-vertical concrete surfaces, and its characteristic operating method, of the type used in its construction, assembly, maintenance and/or repair to raise and lower various types of associated metal structures, both on vertical and quasi-vertical, flat or curved surfaces, with free geometry and variable gradient. Quasi-vertical surfaces are understood as those which, without being totally vertical, have inclination so high that they approximate verticality, and in some cases this can be confused. The present invention allows going up or climbing any structure, device or machine, such as, for example, a crane or a working platform.

FIELD OF THE INVENTION

The invention relates to the field of auxiliary assembly structures for constructive concrete surfaces and elements, both prefabricated and concreted in situ.

CURRENT STATE OF THE ART

At present, a large quantity of self-climbing devices and structures are known in the construction field, among which we can highlight patents EP2725166 "Method for establishing concreting sections with the help of a track-guided self-climbing shuttering system", EP1899549 "Climbing cylinder of a self-climbing shuttering", WO2009117986 "Track-guided self-climbing shuttering system with climbing rail extension pieces", EP2365159 "Self-climbing perimeter structure for construction works in buildings" and WO2008061922 "Track-guided self-climbing shuttering system with climbing rail extension pieces". However, all suffer a common problem, that they all need tracks, guides or rails solidly joined to the working surface, which complicate and make its assembly and later dismantling more expensive, in addition to being solely applicable to flat surfaces, which means they are not applicable in many cases, such as, for example, multisectional prefabricated concrete towers.

Likewise, another type of devices is known, such as that described in patent EP2518239 "Climbing head to lift a self-climbing protection system for construction work in buildings", but it also has shortcomings, in this case, as it needs two lateral beams solidly joined to the surface.

On the other hand, devices are also used such as that disclosed in patent WO2013171359 "Self-climbing telescopic crane and method for mounting pre-fabricated concrete towers" and ES2435211 "System for assembly of a prefabricated concrete tower comprising a self-climbing telescopic crane", that climb up the inside of the tower, in a more complex process, and continue to require external rails for the parts to raise. They also have the drawback that they are solely applicable to hollow concrete towers, limiting the scope of its application.

Systems are also knowns such as that claimed in patent ES2085196 "Self-climbing shuttering system and continuous concrete support", which uses anchoring cones for fixing to the wall, but it is not a structure that autonomously climbs, but is a shuttering for dams that is dismantled from the lower part and raising it to the upper part in a fairly manual way.

DESCRIPTION OF THE INVENTION

To resolve the problem existing at present in the assembly and raising of working structures on concrete surfaces and elements, the self-climbing device for vertical and quasi-vertical concrete surfaces has been devised, comprised of a main body, formed by a vertical metal structure, in lattice or a tube, of circular section, quasi-rectangular or another structural element, equipped with a main beam, vertically disposed, by way of displacement rail, and at least, three upper, intermediate and lower self-motorized frames, or trolleys, independent of each other and separately controllable, displaceable along the main beam of the main body. The distance (vertical) of the upper, intermediate and lower self-motorized frames, between anchorings is free, and, therefore, the length of each individual advance of the system, obviously limited by the length of the main body.

The device also comprises an associated metal working structure, solidly joined to the main body. Said metal structure will depend on the operating function of the device, although it will be preferably chosen from the group formed by crane, working platform, scaffolding, shuttering and supports.

The upper, intermediate and lower self-motorized frames comprise, in turn, a sliding part, partially surrounding the main beam, a chassis horizontally displaceable with respect to the sliding part and an anchoring chassis with capacity of rotation with respect to the displaceable chassis by means of a vertically positioned shaft between both.

Said self-motorized frames have means of vertical displacement with respect to the main body, which comprises one or several motors, equipped with gearboxes and pinions or attack gears, all disposed on the sliding part, which are connected to one or several racks vertically disposed on the main beam of the main body.

Likewise the self-motorized frames have locking means of vertical displacement with respect to the main body, located in the displaceable chassis. These locking means may be formed from pins, bolts, wedges or any other known technical solution that prevents the movement between both parts when actuated.

The self-motorized frames also have anchoring means to the working wall, which comprises a protuberance of the anchoring chassis, emerging in the face adjacent to the working wall, equipped with one or several locking elements actuable and laterally disposed on said protuberance, with the protuberance being of shape and size that coincide with anchoring housings disposed in the working wall, in vertical line, and with these anchoring housings having locking housings, of size, shape and position that coincide with the locking elements. The shape of the anchoring chassis protuberance, and of the anchoring housings disposed in the working wall will preferably be chosen from the group formed by truncated pyramid and truncated cone-shape.

Likewise, the self-motorized frames have means of horizontal displacement with respect to the working wall, which comprise at least two linear actuators, actuated by motors, disposed on the sides of the sliding part, and traversing the displaceable chassis through an opening, and connected at their ends with the anchoring chassis by means of vertically positioned rotation axes. These means of horizontal displacement enable both the approximation to and distancing from necessary for the coupling and fixing of the device to the working wall, and the adaptation of the distance between the device and the working wall, if the latter is not regular, such as, for example, in the case of prefabricated concrete towers of variable section by segments.

Likewise, the self-motorized frames have rotation means of the main body, in the horizontal plane, with respect to the working wall, which comprises the anchoring chassis, the displaceable chassis, the vertically positioned shaft between both, and the linear actuators together with the motors. This encourages the possibility of having a rotation of the device with respect to the working wall, especially useful when the device is associated to a crane for the assembly of prefabricated concrete towers and for the housing of the nacelle and blades until its upper end.

In all these elements, the motors and the linear actuators can be of any of the types known at present, or a combination of several types, although preferably they will be of electric, pneumatic or hydraulic type.

This device involves a specific operating method which comprises a working phase and an upward or downward movement phase.

The working phase comprises the anchoring to the working wall of at least two of the upper, intermediate or lower self-motorized frames, by means of the corresponding anchoring means to the working wall, and the locking of the vertical displacement of said self-motorized frames with respect to the main body by means of the corresponding locking means. In this phase, the device is solidly joined to the main body and its associated metal working structure to the working wall.

The upward movement phase comprises the following steps, which shall be repeated until achieving the desired working height:

step 1—wherein the device is in working phase, with at least the upper and intermediate self-motorized frames anchored to the working wall, step 2—the lower self-motorized frame is released from its anchoring to the working wall, and it separates from it by means of actuation of the means of horizontal displacement with respect to the working wall, the device thus being fastened to the working wall solely by means of the upper and intermediate self-motorized frames, step 3—the lower self-motorized frame releases its locking means of vertical displacement with respect to the main body and slides upwards by means of actuation of the means of vertical displacement with respect to the main body until being positioned beside the intermediate self-motorized frame, step 4—the lower self-motorized frame approximates the working wall by means of actuation of the means of horizontal displacement with respect to the working wall and it anchors to it in the free anchoring housing beside the intermediate self-motorized frame, step 5—release of the locking means of vertical displacement with respect to the main body of the lower and intermediate self-motorized frames, fixed to the working wall, the means of vertical displacement with respect to the main body are actuated and its upward vertical displacement to the new position occurs, wherein the lower self-motorized frame is located at the lower end of the main body, step 6—actuation of the locking means of vertical displacement with respect to the main body of the lower self-motorized frame, producing the locking of the main body, step 7—the intermediate self-motorized frame is released from its anchoring to the working wall, and it separates from it by means of actuation of the means of horizontal displacement with respect to the working wall, the device thus being fastened to the working wall solely by means of the upper and lower self-motorized frames, step 8—the intermediate self-motorized frame releases its locking means of vertical displacement with respect to the main body and slides upwards by means of actuation of the means of vertical displacement with respect to the main body until being positioned beside the upper self-motorized frame, step 9—the intermediate self-motorized frame approximates the working wall by means of actuation of the means of horizontal displacement with respect to the working wall and it anchors it in the free anchoring housing beside the upper self-motorized frame, also actuating its locking means of vertical displacement with respect to the main body, step 10—the upper self-motorized frame is released from its anchoring to the working wall, and it separates from it by means of actuation of the means of horizontal displacement with respect to the working wall, the device thus being fastened to the working wall solely by means of the intermediate and lower self-motorized frames, step 11—the upper self-motorized frame releases its locking means of vertical displacement with respect to the main body and slides upwards by means of actuation of the means of vertical displacement with respect to the main body until being positioned at its upper end, and step 12—the upper self-motorized frame approximates the working wall by means of actuation of the means of horizontal displacement with respect to the working wall and it anchors it in the free anchoring housing beside the upper end of the main body, also actuating its locking means of vertical displacement with respect to the main body, again remaining in the initial working phase.

The downward movement phase comprises the following steps, which shall be repeated until achieving the desired working height or until reaching the ground for dismantling:

step 1—wherein the device is in working phase, with at least the intermediate and lower self-motorized frames anchored to the working wall, step 2—the upper self-motorized frame is released from its anchoring to the working wall, and it separates from it by means of actuation of the means of horizontal displacement with respect to the working wall, the device thus being fastened to the working wall solely by means of the lower and intermediate self-motorized frames, step 3—the upper self-motorized frame releases its locking means of vertical displacement with respect to the main body and it slides downwards by means of actuation of the means of vertical displacement with respect to the main body until being positioned beside the intermediate self-motorized frame, step 4—the upper self-motorized frame approximates the working wall by means of actuation of the means of horizontal displacement with respect to the working wall and it anchors to it in the free anchoring housing beside the intermediate self-motorized frame, step 5—release of the locking means of vertical displacement with respect to the main body of the self-motorized frames fixed to the working wall, the means of vertical displacement with respect to the main body and are actuated and its vertical displacement downward to the new position occurs, wherein the upper self-motorized frame is located at the upper end of the main body, step 6—actuation of the locking means of vertical displacement with respect to the main body of the upper self-motorized frame, producing the locking of the main body, step 7—the intermediate self-motorized frame is released from its anchoring to the working wall, and it separates from it by means of actuation of the means of horizontal displacement with respect to the working wall, the device thus being fastened to the working wall solely by means of the upper and lower self-motorized frames, step 8—the intermediate self-motorized frame releases its locking means of vertical displacement with respect to the main body and it slides downwards by means of actuation of the means of vertical displacement with respect to the main body until being positioned beside the lower self-motorized frame, step 9—the intermediate self-motorized frame approximates the working wall by means of actuation of the means of horizontal displacement with respect to the working wall and it anchors it in the free anchoring housing beside the lower self-motorized frame, also actuating its locking means of vertical displacement with respect to the main body, step 10—the lower self-motorized frame is released from its anchoring to the working wall, and it separates from it by means of actuation of the means of horizontal displacement with respect to the working wall, the device thus being fastened to the working wall solely by means of the self-motorized frames intermediate and upper, step 11—the lower self-motorized frame releases its locking means of vertical displacement with respect to the main body and it slides downwards by means of actuation of the means of vertical displacement with respect to the main body until being positioned at its lower end, and step 12—the lower self-motorized frame approximates the working wall by means of actuation of the means of horizontal displacement with respect to the working wall and it anchors it in the free anchoring housing beside the end lower of the main body, also actuating its locking means of vertical displacement with respect to the main body, again remaining in the initial working phase.

Advantages of the Invention

This self-climbing device for vertical and quasi-vertical concrete surfaces presented provides multiple advantages over the devices available at present, the most important one being that it allows going up or climbing any structure, device or machine, such as, for example, a crane or a working platform.

Another advantage of the present invention is that it is applicable and useable in both vertical and quasi-vertical, flat or curved surfaces, with free geometry and with variable gradient. It is important to highlight that, as it is possible to work on surfaces of free geometry, it is especially applicable, for example, to wind turbine towers, bridge stacks or walls and pillars of structures of all types.

Another important advantage is that the financial cost of this device is considerably more reduced than another type of equivalent elements, to work at the same height, with a great saving in assembly and operating time.

Another advantage of the present invention is that it is easily to dismantle, transport and reuse, and can be used to access even the most difficult working environments, which makes it more profitable financially.

Likewise, another advantage is the low visual and structural impact it has on the concrete surface once removed, since the anchoring housings can be easily covered.

Furthermore, the distance (vertical) between anchors is free and, therefore, the length of each individual advance of the system, obviously limited by the length of the main body.

DESCRIPTION OF THE FIGURES

To better understand the object of the present invention, the attached plan has represented a preferred embodiment of a self-climbing device for vertical and quasi-vertical concrete surfaces.

In said plan, FIG. 1—shows a view of the device positioned on the surface of a multisectional prefabricated concrete tower.

PREFERRED EMBODIMENT OF THE INVENTION

The constitution and characteristics of the invention can be better understood with the following description made with reference to the attached figures.

Figure 1:
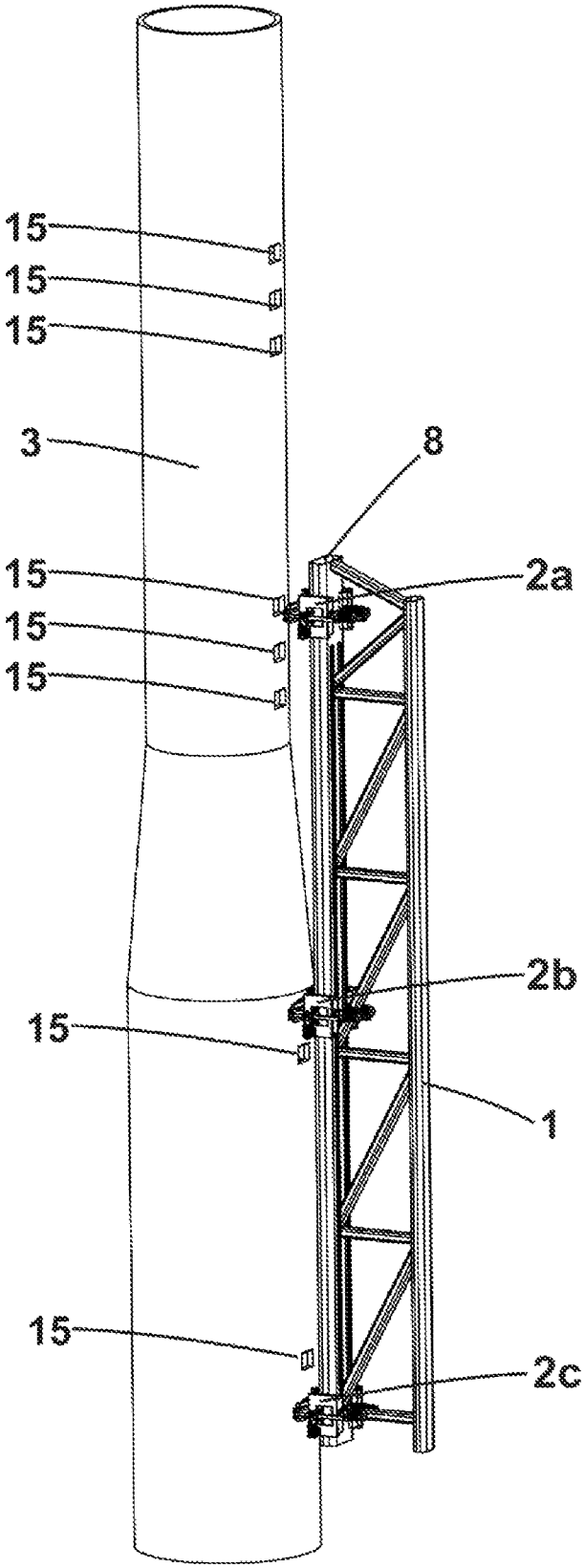

As can be observed in FIG. 1, the main body (1) of the device is illustrated, formed by a vertical metal structure, in lattice or a tube, of circular section, quasi-rectangular or another structural element, equipped with a main beam (8), vertically disposed, by way of displacement rail, and at least three upper (2*a*), intermediate (2*b*) and lower (2*c*) self-motorized frames or trolleys, independent of each other and separately controllable, displaceable along the main beam (8) of the main body (1).

Said main body (1) is shown positioned on the surface of a multisectional prefabricated concrete tower, which shows in its working wall (3) a plurality of anchoring housings (15), designed for a specific operating method that comprises a working phase and an upward or downward movement phase.

The working phase comprises the anchoring to the working wall (3) of at least two of the upper (2*a*), intermediate (2*b*) or lower (2*c*) self-motorized frames, by means of the corresponding anchoring means (15) to the working wall (3), and the locking of vertical displacement of the upper (2*a*), intermediate (2*b*) or lower (2*c*) self-motorized frames, with respect to the main body (1) by means of the corresponding locking means. In this phase, the device solidly joins the main body (1) and its associated metal working structure to the working wall (3).

The upward movement phase comprises twelve steps, which shall be cyclically repeated until achieving the desired working height.

Likewise, the downward movement phase comprises another twelve steps, which shall be repeated until achieving the desired working height or until reaching the ground for the dismantling.

Figures 2, 3:
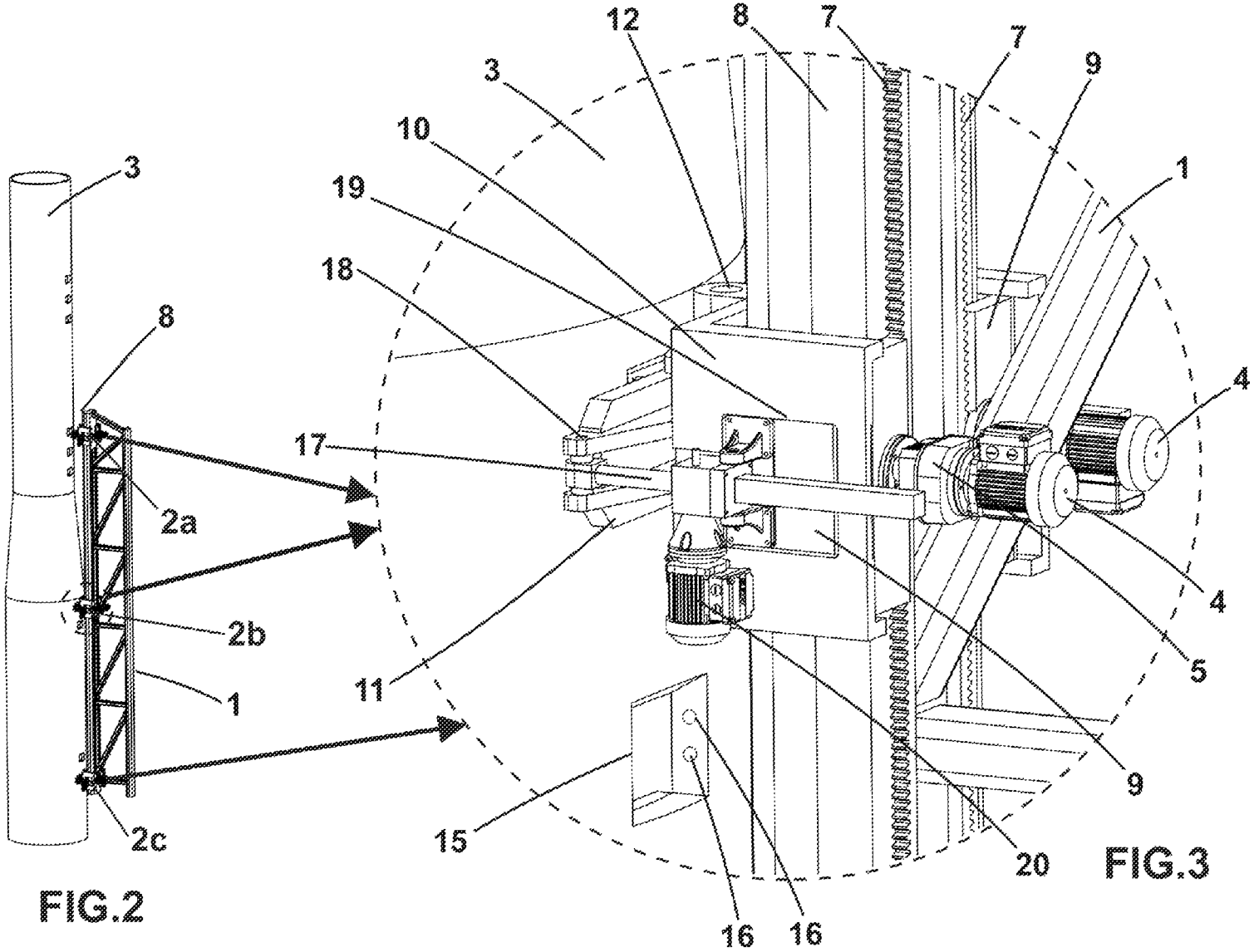
FIG. 2—shows a view of the device positioned on the surface of a prefabricated concrete tower.
FIG. 3—shows an expanded construction detail of any one of the upper, intermediate or lower self-motorized frames.

FIG. 2 illustrates the main body (1) of the device, indicating the main beam (8), vertically disposed, by way of displacement rail, and the upper (2*a*), intermediate (2*b*) or lower (2*c*) self-motorized frames, fixed on the working wall (3), indicating an enlargement of the construction detail of any one of the upper (2*a*), intermediate (2*b*) or lower (2*c*) self-motorized frames. FIG. 3 shows a construction detail of any one of the upper (2*a*), intermediate (2*b*) or lower (2*c*) self-motorized frames, in turn comprising a sliding part (9), partially surrounding the main beam (8), a chassis (10) horizontally displaceable with respect to the sliding part (9) and an anchoring chassis (11) with capacity of rotation with respect to the displaceable chassis (10) by means of a vertically positioned shaft (12) between both.

Said upper (2*a*), intermediate (2*b*) or lower (2*c*) self-motorized frames have means of vertical displacement with respect to the main body (1), which comprises one or several motors (4), equipped with gearboxes (5) and pinions (6) or attack gears (not illustrated), all disposed on the sliding part (9), which are connected to one or several racks (7) vertically disposed on the main beam (8) of the main body (1).

Likewise the upper (2*a*), intermediate (2*b*) or lower (2*c*) self-motorized frames, show locking means of vertical displacement with respect to the main body (1), located in the displaceable chassis (10). These locking means can be formed by pins, bolts, wedges or any other known technical solution that prevents the movement between both parts on actuating.

Likewise, the upper (2*a*), intermediate (2*b*) or lower (2*c*) self-motorized frames have means of horizontal displacement with respect to the working wall (3), which comprises at least two linear actuators (17), actuated by motors (20), disposed on the sides of the sliding part (9), and traversing the displaceable chassis (10) through an opening (19), and connected at their ends with the anchoring chassis (11) by means of vertically positioned rotation axes (18). These means of horizontal displacement enable both the approximation and distancing necessary for the coupling and fixing of the device to the working wall (3), and the adaptation of the distance between the device and the working wall (3) in the case that the latter is not regular, such as, for example, in the case of prefabricated concrete towers of variable section by segments. The upper (2*a*), intermediate (2*b*) or lower (2*c*) self-motorized frames have rotation means of the main body (1), in the horizontal plane, with respect to the working wall (3), which comprises the anchoring chassis (11), the displaceable chassis (10), the vertically positioned shaft (12) between both, and the linear actuators (17) together with the motors (20). This encourages the possibility of having a rotation of the device with respect to the working wall, especially useful when the device is associated to a crane for the assembly of prefabricated concrete towers and for the hoisting of the nacelle and blades to its upper end.

It shows the motors (4), the motors (20) and the linear actuators (17), which can be of any of the types known at present, or a combination of various types, although they will preferably be of electric, pneumatic or hydraulic type.

It also shows anchoring housings (15) disposed in the working wall (3), in vertical line, and these anchoring housings (15) having locking housings (16).

Figure 4:
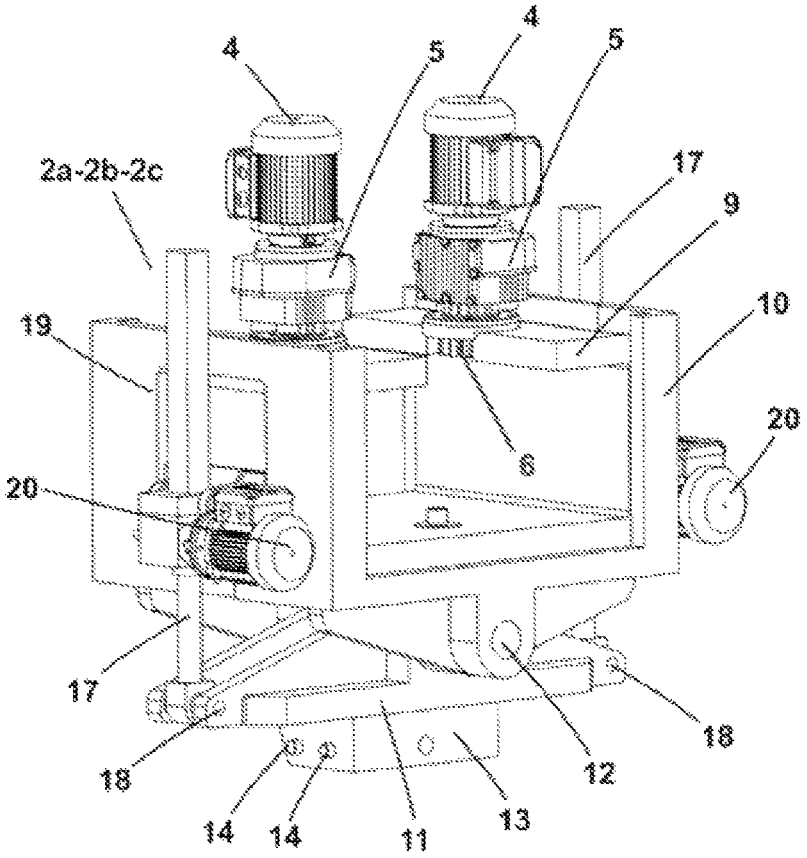
FIGS. 4, 5 and 6—show construction details of any one of the upper, intermediate or lower self-motorized frames

FIG. 4 illustrates one of the upper (2*a*), intermediate (2*b*) or lower (2*c*) self-motorized frames, in a position rotated 90°, indicating the displaceable chassis (10) completely adhered to the sliding part (9), and with the anchoring chassis (11) parallel to the displaceable chassis (10), without rotating.

Figure 5:
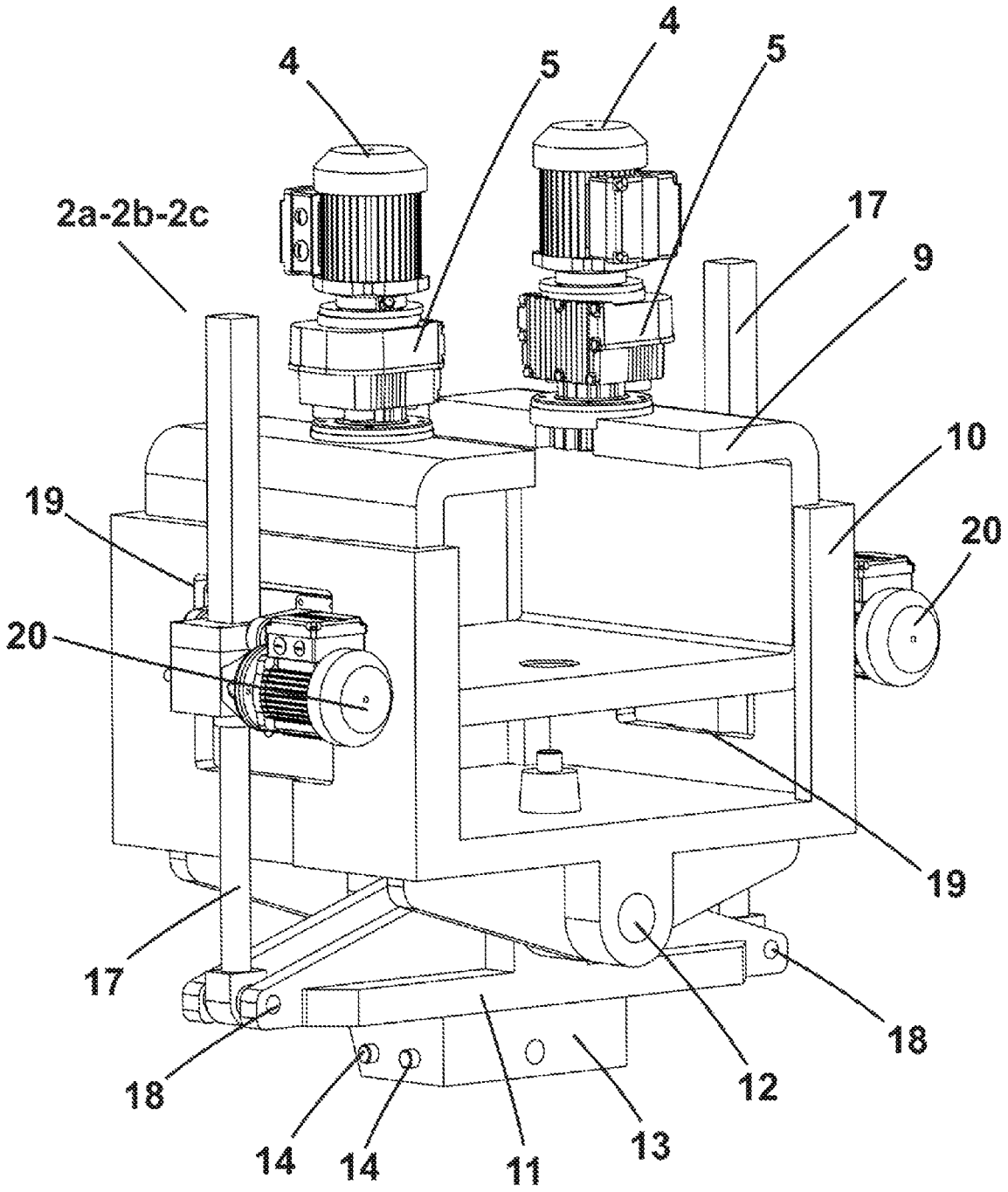

FIG. 5 illustrates one of the upper (2*a*), intermediate (2*b*) or lower (2*c*) self-motorized frames, in a position rotated 90°, indicating the displaceable chassis (10) separate from the sliding part (9), and with the anchoring chassis (11) parallel to the displaceable chassis (10), without rotating.

Figure 6:
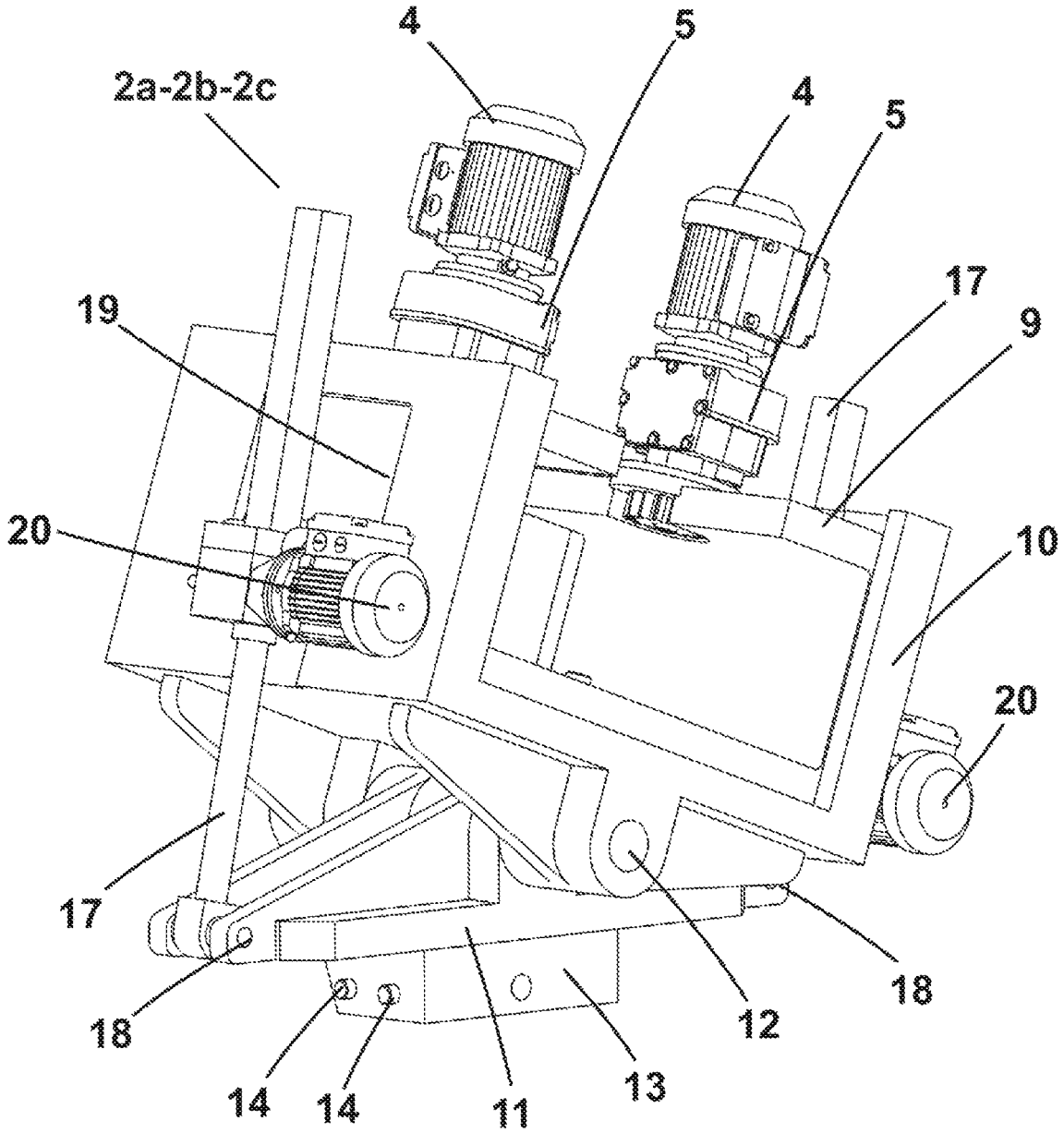

FIG. 6 illustrates one of the upper (2*a*), intermediate (2*b*) or lower (2*c*) self-motorized frames, in a position rotated 90°, indicating the displaceable chassis (10) completely adhered to the sliding part (9), and with the anchoring chassis (11) rotated with respect to the displaceable chassis (10).

FIGS. 4, 5 and 6 show any one of the upper (2*a*), intermediate (2*b*) or lower (2*c*) self-motorized frames, which have anchoring means to the working wall consisting of a protuberance (13) of the anchoring chassis (11), equipped with one or several locking elements (14) actuable and laterally disposed on said protuberance (13), said protuberance (13) having a configuration preferably chosen from the group formed by truncated pyramid and truncated cone shape.

It also shows the vertically positioned shaft (12) and the linear actuators (17) actuated by motors (20), disposed on the sides of the sliding part (9), and traversing the displaceable chassis (10) through an opening (19), and connected at their ends with the anchoring chassis (11) by means of rotation axes (18).

It shows the motors (4), equipped with gearboxes (5) provided for the vertical displacement, disposed on the sliding part (9).

The invention claimed is:

1. Self-climbing device for vertical and quasi-vertical concrete surfaces, of the type used in its construction, assembly, maintenance and/or repair to raise and lower various types of associated metal structures, characterized in that it comprises a main body (1), formed by a vertical metal structure, chosen from the group formed by lattice, tube, circular section, quasi-rectangular, equipped with a main beam (8), vertically disposed, and three self-motorized frames, said three self-motorized frames being an upper self-motorized frame (2*a*), an intermediate self-motorized frame (2*b*) and a lower self-motorized frame (2*c*), independent of each other and separately controllable, displaceable along the main beam (8) of the main body (1);

wherein the upper self-motorized frame (2*a*), the intermediate self-motorized frame (2*b*) and the lower self-motorized frame (2*c*), comprise means for horizontal displacement; and wherein the means of horizontal displacement of the upper self-motorized frame (2*a*), the intermediate self-motorized frame (2*b*) and the lower self-motorized frame (2*c*), with respect to a working wall (3) comprise at least two linear actuators (17), actuated by motors (20), disposed on the sides of a sliding part (9), and traversing a displaceable chassis (10) through an opening (19), and connected at their ends with an anchoring chassis (11) by means of vertically positioned rotation axes (18).

2. Self-climbing device for vertical and quasi-vertical concrete surfaces, according to claim 1, characterized in that the upper self-motorized frame (2*a*), intermediate self-motorized frame (2*b*) and lower self-motorized frame (2*c*) have means of vertical displacement with respect to the main body (1), locking means of vertical displacement with respect to the main body (1), anchoring means to the working wall (3), and rotation means of the main body, in the horizontal plane, with respect to the working wall (3).

3. Self-climbing device for vertical and quasi-vertical concrete surfaces, according to claim 1, characterized in that a means of vertical displacement of the upper self-motorized frame (2*a*), the intermediate self-motorized frame (2*b*) and the lower self-motorized frame (2*c*), with respect to the main body (1) comprises one or several motors (4), with gearboxes (5) and pinions (6) or attack gears, all disposed on the sliding part (9), which are connected to one or several racks (7) vertically disposed on the main beam (8) of the main body (1).

4. Self-climbing device for vertical and quasi-vertical concrete surfaces, according to claim 1, characterized in that a locking means of vertical displacement of the upper self-motorized frame (2*a*), the intermediate self-motorized frame (2*b*) and the lower self-motorized frame (2*c*), with respect to the main body (1), are located in the displaceable chassis (10).

5. Self-climbing device for vertical and quasi-vertical concrete surfaces, according to claim 1, characterized in that an anchoring means to the working wall (3) of the upper self-motorized frame (2*a*), the intermediate self-motorized frame (2*b*) and the lower self-motorized frame (2*c*), comprises a protuberance (13) of the anchoring chassis (11), emerging in the face adjacent to the working wall (3), equipped with one or several locking elements (14) actuable and laterally disposed on said protuberance (13), with the protuberance (13) being of shape and size that coincide with anchoring housings (15) disposed in the working wall (3), in vertical line, and with these anchoring housings (15) having locking housings (16), of size, shape and position that coincide with the several locking elements (14).

6. Self-climbing device for vertical and quasi-vertical concrete surfaces, according to claim 5, characterized in that the protuberance (13) of the anchoring chassis (11), and the anchoring housings (15) disposed in the working wall (3) adopt a shape chosen from the group formed by truncated pyramid and truncated cone-shape.

7. Self-climbing device for vertical and quasi-vertical concrete surfaces, according to claim 1, characterized in that the motors (20) and linear actuators (17) are of the type chosen from the group formed by electric, pneumatic, hydraulic or a combination thereof.

8. Self-climbing device for vertical and quasi-vertical concrete surfaces, according to claim 2, characterized in that the rotation means of the main body, in the horizontal plane, with respect to the working wall (3) comprises the anchoring chassis (11), the displaceable chassis (10), a vertically disposed axis (12) between both, and the linear actuators (17) together with the motors (20).

9. Self-climbing device for vertical and quasi-vertical concrete surfaces, according to claim 1, characterized in that it comprises an associated metal working structure, solidly joined to the main body (1), chosen from the group formed by crane, working platform, scaffolding, shuttering and supports.

10. Operating method of a self-climbing device for vertical and quasi-vertical concrete surfaces, according to claim 1, characterized in that it comprises a working phase and an upward or downward movement phase.

11. Operating method of a self-climbing device for vertical and quasi-vertical concrete surfaces, according to claim 10, characterized in that the working phase comprises the anchoring to the working wall (3) of at least two of the upper self-motorized frame (2*a*), the intermediate self-motorized frame (2*b*) and the lower self-motorized frame (2*c*) by means of their anchoring chassis to the working wall (3), and the locking of vertical displacement of said self-motorized frames, with respect to the main body (1) by means of locking means.

12. Operating method of a self-climbing device for vertical and quasi-vertical concrete surfaces, according to claim 10, characterized in that the upward movement phase comprises the following steps, which shall be repeated until achieving a desired working height:

step 1—wherein the device is in the working phase, with at least the upper self-motorized frame (2*a*), the intermediate self-motorized frame (2*b*) and the lower self-motorized frame (2*c*), anchored to the working wall (3), step 2—unlocking of the anchoring to the working wall (3) of the lower self-motorized frame (2*c*) and of separation from the working wall by the means of horizontal displacement with respect to the working wall (3), the device being fastened to the working wall (3) solely by means of the upper self-motorized frame (2*a*), the intermediate self-motorized frame (2*b*) and the lower self-motorized frame (2*c*), step 3—unlocking of locking means of vertical displacement with respect to the main body (1) of the lower self-motorized frame (2*c*) and of sliding upwards by means of vertical displacement with respect to the main body (1) until being positioned beside the intermediate self-motorized frame (2*b*), step 4—approaching the working wall (3) of the lower self-motorized frame (2*c*), by the means of horizontal displacement with respect to the working wall (3), and of anchoring in free anchoring housing (15) beside the intermediate self-motorized frame (2*b*), step 5—unlocking of the locking means of vertical displacement with respect to the main body (1) of the intermediate self-motorized frame (2*b*) and the lower self-motorized frame (2*c*), fixed to the working wall (3), and of upward vertical displacement, by the means of vertical displacement with respect to the main body (1), reaching a new position wherein the lower self-motorized frame (2*c*), is located at a lower end of the main body (1), step 6—braking of the main body (1) by means of the locking means of vertical displacement with respect to the main body (1) of the lower self-motorized frame (2*c*), step 7—unlocking of the anchoring to the working wall (3) of the intermediate self-motorized frame (2*b*), and of separation from it by the means of horizontal displacement with respect to the working wall (3), the device being fastened to the working wall (3) solely by means of the upper self-motorized frame (2*a*) and the lower self-motorized frame (2*c*), step 8—unlocking of the locking means of vertical displacement with respect to the main body (1) of the intermediate self-motorized frame (2*b*), and of sliding upwards by the means of vertical displacement with respect to the main body (1) until being positioned beside the upper self-motorized frame (2*a*), step 9—approaching the intermediate self-motorized frame (2*b*), to the working wall (3) by the means of horizontal displacement with respect to the working wall (3), of anchoring in the free anchoring housing (15) beside the upper self-motorized frame (2*a*), and braking by means of its locking means of vertical displacement with respect to the main body (1), step 10—unlocking of the anchoring to the working wall (3) of the upper self-motorized frame (2*a*), and of separation from it by the means of horizontal displacement with respect to the working wall (3), the device being fastened to the working wall (3) solely by means of the intermediate self-motorized frame (2*b*) and the lower self-motorized frame (2*c*), step 11—unlocking of the locking means of vertical displacement with respect to the main body (1) of the upper self-motorized frame (2*a*) and of sliding upwards by the means of vertical displacement with respect to the main body (1) until being positioned at an upper end, and step 12—approaching the upper self-motorized frame (2*a*) to the working wall (3) by the means of horizontal displacement with respect to the working wall (3), of anchoring in the free anchoring housing (15) beside the upper end of the main body (1), and braking by means of its locking means of vertical displacement with respect to the main body (1), again remaining in the initial working phase.

13. Operating method of a self-climbing device for vertical and quasi-vertical concrete surfaces, according to claim 10, characterized in that the downward movement phase comprises the following steps, which shall be repeated until achieving a desired working height or dismantling, step 1—wherein the device is in the working phase, with at least the intermediate self-motorized frame (2*b*) and the lower self-motorized frame (2*c*) anchored to the working wall (3), step 2—unlocking of the anchoring to the working wall (3) of the upper self-motorized frame (2*a*) and of separation from the working wall by the means of horizontal displacement with respect to the working wall (3), the device being fastened to the working wall (3) solely by means of the lower self-motorized frame (2*c*) and the intermediate self-motorized frame (2*b*), step 3—unlocking of the locking means of vertical displacement with respect to the main body (1) of the upper self-motorized frame (2*a*) and of sliding downwards by the means of vertical displacement with respect to the main body (1) until being positioned beside the intermediate self-motorized frame (2*b*), step 4—approaching the working wall (3) of the upper self-motorized frame (2*a*), by the means of horizontal displacement with respect to the lower working wall (3), and of anchoring in the free anchoring housing (15) beside the intermediate self-motorized frame (2*b*), step 5—unlocking of the locking means of vertical displacement with respect to the main body (1) of the upper self-motorized frame (2*a*) and the intermediate self-motorized frame (2*b*), fixed to the working wall (3), and of downward vertical displacement, by the means of vertical displacement with respect to the main body (1), reaching a new position wherein the lower self-motorized frame (2*c*), is located at the upper end of the main body (1), step 6—braking of the main body (1) by means of the locking means of vertical displacement with respect to the main body (1) of the upper self-motorized frame (2*a*), step 7—unlocking of the anchoring to the working wall (3) of the intermediate self-motorized frame (2*b*), and of separation from it by the means of horizontal displacement with respect to the working wall (3), the device being fastened to the working wall (3) solely by means of the upper self-motorized frame (2*a*) and the lower self-motorized frame (2*c*), step 8—unlocking of the locking means of vertical displacement with respect to the main body (1) of the intermediate self-motorized frame (2*b*) and of sliding downwards by the means of vertical displacement with respect to the main body (1) until being positioned beside the lower self-motorized frame (2*c*), step 9—approaching the intermediate self-motorized frame (2*b*), to the working wall (3) by the means of horizontal displacement with respect to the working wall (3), of anchoring in the free anchoring housing (15) beside the upper self-motorized frame (2*a*), and braking by means of its locking means of vertical displacement with respect to the main body (1), step 10—unlocking of the anchoring to the working wall (3) of the lower self-motorized frame (2*c*), and of separation from it by the means of horizontal displacement with respect to the working wall (3), the device being fastened to the working wall (3) solely by means of the intermediate self-motorized frame (2*b*) and the upper self-motorized frame (2*a*), step 11—unlocking of the locking means of vertical displacement with respect to the main body (1) of the lower self-motorized frame (2*c*) and of sliding downwards by the means of vertical displacement with respect to the main body (1) until being positioned at its lower end, and step 12—approaching the lower self-motorized frame (2*c*), to the working wall (3) by the means of horizontal displacement with respect to the working wall (3), of anchoring in the free anchoring housing (15) beside the upper end of the main body (1), and braking by means of its locking means of vertical displacement with respect to the main body (1), again remaining in the initial working phase.

* * * * *